United States Patent [19]

Back et al.

[11] Patent Number: 4,818,248

[45] Date of Patent: Apr. 4, 1989

[54] PROCESS FOR DYEING NATURAL OR SYNTHETIC POLYAMIDE FIBRE MATERIALS WITH 1:1 METAL COMPLEX DYES IN PRESENCE OF ALKALI METAL FLUORDSILICATE OR AMINDNLUM SILICATE

[75] Inventors: Gerhard Back, Lörrach, Fed. Rep. of Germany; Walter Mosimann, Therwil, Switzerland

[73] Assignee: Ciba-Geigy Corporation, Ardsley, N.Y.

[21] Appl. No.: 102,942

[22] Filed: Sep. 30, 1987

[30] Foreign Application Priority Data

Oct. 10, 1986 [CH] Switzerland ..... 4061/86

[51] Int. Cl.[4] ..... C09B 67/24; D06P 1/67; D06P 3/24

[52] U.S. Cl. ..... 8/620; 8/632; 8/634; 8/680; 8/685; 8/686; 8/917; 252/8.6; 252/8.7; 252/8.8; 252/8.9

[58] Field of Search ..... 8/632, 685, 686, 620, 8/632, 685, 686; 252/8.7, 8.8, 2.9

[56] References Cited

U.S. PATENT DOCUMENTS 1,372,038 3/1921 Phair ..... 8/598
3,990,842 11/1976 Millsaps ..... 8/632
4,444,564 4/1984 Salathe et al. ..... 8/588
4,623,358 11/1986 Back et al. ..... 8/620
4,681,596 7/1987 Back et al. ..... 8/620

FOREIGN PATENT DOCUMENTS 1090946 11/1967 United Kingdom .

*Primary Examiner*—A. Lionel Clingman
*Attorney, Agent, or Firm*—Wenderoth, Lind & Ponack

[57] ABSTRACT

The present invention relates to a process for dyeing natural or synthetic polyamide fibre material from an aqueous liquor with dyes, in the presence of an alkali metal salt or an ammonium salt and in the presence of an assistant, which process comprises dyeing said fibre material with at least one sulfonated 1:1 metal complex dye or with a mixture containing at least one sulfonated 1:1 metal complex dye and at least one sulfonated metal-free dye, in the presence of 10 to 45 percent by weight of an alkali fluorosilicate or ammonium fluorosilicate or a mixture thereof, based on the amount of the 1:1 metal complex dye employed, and in the presence of an assistant at a pH value of 3 to 5.

The process of the invention is suitable for dyeing natural or synthetic polyamide materials to give non-skittery and level dyeings of good fastness properties.

26 Claims, No Drawings

PROCESS FOR DYEING NATURAL OR SYNTHETIC POLYAMIDE FIBRE MATERIALS WITH 1:1 METAL COMPLEX DYES IN PRESENCE OF ALKALI METAL FLUORDSILICATE OR AMINDNLUM SILICATE

The present invention relates to a novel process for the nonskittery and level dyeing of natural and synthetic polyamide fibre materials from an aqueous liquor with sulfonated 1:1 metal complex dyes or with the dye mixtures containing sulfonated 1:1 metal complex dyes and metal-free sulfonated dyes, in the presence of 10 to 45 percent by weight of an alkali metal fluorosilicate or ammonium fluorosilicate or a mixture thereof, based on the amount by weight of the 1:1 metal complex dye, and in the presence of an assistant, in which process dyeing is carried out at a fibre-preserving pH value of 3 to 5 with virtually complete exhaustion of the dyebath and with good penetration of the dye, and the dyeing so obtained has good allround fastness properties, in particular good wetfastness properties and good lightfastness. The invention further relates to material dyed by the novel process and to a composition for carrying out said process.

The disadvantage of the conventional methods of dyeing natural or synthetic polyamide fibre materials with 1:1 metal complex dyes or mixtures thereof with metal-free acid dyes is that these dyes or mixtures must be applied in the pH range from about 1.9 to 2.8 in order to obtain level dyeings. In addition to the duration of dyeing, the pH of the dyebath is of decisive importance for dyeing natural and synthetic polyamide fibre materials, especially for dyeing wool, as these fibre materials, again in particular wool, are severely attacked both in the strongly acidic and in the strongly alkaline pH range.

Surprisingly, there has now been found a novel process that does not have the shortcomings referred to above and which makes it possible to dye natural or synthetic polyamide materials, in simple manner, in the fibre-preserving pH range from 3 to 5, preferably from 3.5 to 4.5 and, most preferably, from 3.7 to 4.2.

Accordingly, the present invention relates to a process for dyeing natural or synthetic polyamide fibre material from an aqueous liquor with dyes, in the presence of an alkali metal salt or an ammonium salt and in the presence of an assistant, which process comprises dyeing said fibre material with at least one sulfonated 1:1 metal complex dye or with a mixture containing at least one sulfonated 1:1 metal complex dye and at least one sulfonated metal-free dye, in the presence of 10 to 45 percent by weight of an alkali metal fluorosilicate or ammonium fluorosilicate or a mixture thereof, based on the amount of the 1:1 metal complex dye employed, and in the presence of an assistant at a pH value of 3 to 5.

The eligible sulfonated 1:1 metal complex dyes are preferably monoazo or disazo dyes which contain a chromium ion as metal ion. It is also possible to use 1:1 metal complex azomethine dyes which preferably contain a chromium ion.

The eligible sulfonated metal-free dyes are preferably acid to strongly acid dyes selected from the series of the monoazo or polyazo, anthraquinone, triphenylmethane or xanthene dyes that may contain the customary substituents of acid dyes. These sulfonated metal-free dyes may be substituted by fibre-reactive radicals.

Depending on the desired depth of shade, the amounts in which the defined dyes or dye mixtures are added to the dyebaths may vary within wide limits. In general, amounts from 0.01 to 10 percent by weight, based on the goods to be dyed, of one or more dyes are advantageous.

It has long been known to dye natural or synthetic polyamide fibre materials with 1:1 metal complex dyes or mixtures thereof with metal-free dyes in the presence of an alkali metal sulfate or alkali metal chloride, for example sodium sulfate and sodium chloride, and optionally of an assistant. Surprisingly, the use of an alkali metal fluorosilicate or ammonium fluorosilicate or a mixture thereof, even in an amount of 10 to 45 percent by weight, based on the amount of the 1:1 metal complex dye employed, in the presence of an assistant, makes it possible to dye these materials in a fibre-preserving pH range to give level dyeings with good penetration of the dye.

The alkali metal fluorosilicate or ammonium fluorosilicate employed in the process of this invention is the alkali metal salt or ammonium salt of hexafluorosilicic acid or a mixture thereof. It is preferred to use $Na_2SiF_6$ or $(NH_4)_2SiF_6$ or a mixture of $Na_2SiF_6$ and $(NH_4)_2SiF_6$.

Preferred embodiments of the process of this invention comprise:

(a) dyeing the fibre materials with a mixture comprising at least one sulfonated 1:1 metal complex dye and at least one sulfonated metal-free dye, in the presence of 10 to 45 percent by weight of an alkali metal fluorosilicate or ammonium fluorosilicate, based on the amount of the 1:1 metal complex dye employed, and in the presence of an assistant, at a pH value in the range from 3 to 5;

(b) dyeing in the presence of sodium fluorosilicate or, preferably, ammonium fluorosilicate;

(c) dyeing in the presence of a mixture of $Na_2SiF_6$ and $(NH_4)_2SiF_6$, the ratio of $Na_2SiF_6$:$(NH_4)_2SiF_6$ being 20:80 to 80:20.

The amount in which the alkali metal fluorosilicate or ammonium fluorosilicate or mixture thereof is added to the dyebath is 10 to 45 percent by weight, preferably 15 to 45 percent by weight and, most preferably, 20 to 35 percent by weight, based on the amount by weight of the 1:1 metal complex dye.

The expression "amount by weight of the 1:1 metal complex dye" refers to the untreated dye, i.e. to the amount by weight of a dye isolated by conventional methods (e.g. salting out) and containing c. 20 to 40 percent by weight of electrolyte.

The assistants which may be used in the process of this invention are known per se and are prepared by known methods. Preferably, they are levelling assistants or mixtures of different levelling assistants. Suitable levelling assistants are anionic, cationic, nonionic and amphoteric compounds or mixtures thereof.

Examples of suitable anionic compounds are: substituted naphthalenesulfonic acids, sulfonic acid hemiesters of ethoxylates, salts of alkanesulfonic acids of longer chain length, salts of alkylarylsulfonic acids, in particular dodecylbenzenesulfonic acids, fatty acid amide sulfonic acids, and sulfuric acid hemiesters of fatty amine polyglycol ethers. Representative examples of cationic compounds are: polyglycol ethers of fatty amines, polyglycol ethers of fatty acid amide-amines, and quaternary ammonium compounds. Typical examples of nonionic compounds are: polyglycol ethers of fatty alcohols, of alkylphenols, of resinic acids, and of fatty acid alkylolamides. Typical examples of amphoteric compounds are: reaction products of ethoxylated fatty amines and hydroxyethanesulfonic acids, reaction products of phenol and styrene, and polyethylene glycol di-fatty acid esters.

It is preferred to use levelling assistant compositions containing compounds of the formula

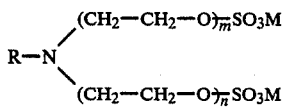

(1)

or

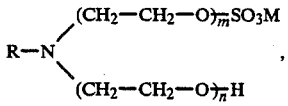

(1a)

wherein R is an alkyl or alkenyl radical of 12 to 22 carbon atoms, M is hydrogen, an alkali metal or ammonium cation, and m and n are integers, the sum of m+n being from 2 to 14; or compounds of the formula

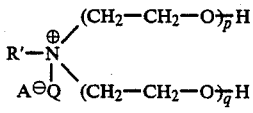

(2)

wherein R' independently of R has the meaning of R, A is an anion, Q is an unsubstituted or substituted alkyl radical and p and q are integers, the sum of p+q being from 2 to 50; or compounds of the formula

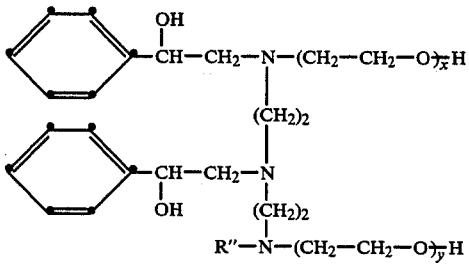

(3)

wherein R'' independently of R has the meaning of R and x and y are integers, the sum of x+y being from 80 to 140; or a mixture containing compounds of formulae (1) and (2) or a mixture containing compounds of formulae (1), (2) and (3), or a mixture containing compounds of formulae (1a), (2) and (3).

It is particularly preferred to use a mixture of levelling assistants comprising 5 to 70 parts by weight of a compound of formula (1) or (1a), 15 to 60 parts by weight of the compound of formula (2), and 5 to 60 parts by weight of the compound of formula (3), based on 100 parts by weight of said mixture, wherein R, R' and R'' in formulae (1), (1a), (2) and (3) are each independently an alkyl or alkenyl radical of 16 to 22 carbon atoms.

It is advantageous to use a compound of formula (2), wherein A and Q are derived from a quaternising agent selected from the group consisting of chloroacetamide, ethylene chlorohydrin, ethylene bromohydrin, epichlorohydrin, epibromohydrin or, preferably, dimethyl sulfate.

In the process of this invention it is preferred to use a mixture of levelling assistants which, in addition to comprising the compounds of the formulae (1) or (1a), (2) and (3), wherein the sum of p+q in formula (2) is preferably from 20 to 50, also contains an adduct of 60 to 100 moles of ethylene oxide with 1 mole of a $C_{15}$–$C_{20}$alkenyl alcohol.

It is also preferred to use a mixture of levelling assistants which contains the compounds of the formulae (1) and (2) or (1a) and (2), wherein the sum of p+q in formula (2) is 4 to 10.

It is further preferred to use a mixture of levelling assistants which contains compounds of formula (2), wherein the sum of p+q in formula (2) to 30 to 40, and R' is a $C_{15}$–$C_{22}$alkyl radical.

In the process of this invention it is most preferred to use a mixture of levelling assistants comprising the compound of formula (1a), wherein R is a $C_{16}$–$C_{18}$alkyl radical and the sum of m+n is 7 or 8, the compound of formula (2), wherein R' is a $C_{20}$–$C_{22}$alkyl radical, A and Q are derived from the quarternising agent dimethyl sulfate, and the sum of p+q is 7 or 8, the compound of formula (2), wherein R' is a $C_{20}$–$C_{22}$alkyl radical, A and Q are derived from the quaternising agent dimethyl sulfate, and the sum of p+q is 34, and the compound of formula (3), wherein R'' is a $C_{20}$–$C_{22}$alkyl radical and the sum of x+y is 106. The most preferred mixture of levelling assistants can contain, in addition to water, e.g. an adduct of 60 to 100 moles of ethylene oxide with 1 mole of a $C_{15}$–$C_{20}$alkenyl alcohol, preferably an adduct of 80 moles of ethylene oxide with 1 mole of oleyl alcohol.

First and foremost, the most preferred mixture of levelling agents contains 20 to 40 parts by weight of the compound of formula (1a), 20 to 40 parts by weight of the compound of formula (2), wherein the sum of p+q is 7 or 8, 10 to 25 parts by weight of the compound of formula (2), wherein the sum of p+q is 34, 3 to 9 parts by weight of the compound of formula (3) and, optionally, up to 8 parts by weight of the adduct of ethylene oxide with an alkenyl alcohol, based on 100 parts of the anhydrous mixture of levelling agents.

The amount in which the levelling assistant or mixture of levelling assistants is added to the dyebaths can vary within wide limits; but in general an amount of 0.3 to 3 percent by weight, preferably of 1 to 2 percent by weight, based on the fibre material, of the levelling assistant or mixture thereof, is advantageous.

The dyebaths may contain, as further assistants, mineral acids such as sulfuric acid, sulfamic acid or phosphoric acid, or organic acids, preferably lower aliphatic carboxylic acids, such as formic acid, acetic acid or maleic acid. These acids are employed in particular for adjusting the pH of the dyebath. It is preferred to adjust the pH of 3 to 5 with an organic acid, preferably with acetic acid or formic acid.

Dyeing is preferably carried out in the pH range from 3.5 to 4.5 and, most preferably, from 3.7 to 4.2.

The dyebath may contain, as further assistants, a salt other than an alkali metal fluorosilicate or ammonium fluorosilicate, in particular an ammonium salt or alkali metal salt, for example ammonium sulfate or, preferably, sodium sulfate. It is preferred to use 1 to 10 percent by weight of ammonium salt or alkali metal salt, based on the fibre material.

The 1:1 metal complex dyes suitable for use in the process of this invention are preferably those that contain at least one 1:1 chromium complex azo or azomethine dye containing 1 to 3, preferably 1 or 2, sulfo groups, and, in the case of dye mixtures, additionally at least one metal-free dye containing 1 or 2 sulfo groups.

The sulfonated metal-free dyes employed in the process of this invention are preferably those having good migration properties. The migrating power of these dyes shall correspond to those of the 1:1 chromium complex azo or azomethine dyes.

The migrating power is determined on wool by treating a sample which has been dyed to 1/1 standard depth of shade, together with an undyed sample of the same weight, in a blank bath.

The treatment conditions for determining the migrating power match those indicated to Example 1. Evaluation is made by spectrophotometric determination of the amount of dye present on the originally undyed wool as a percentage of the originally dyed wool.

A range from 25 to 50% has proved advantageous as a good migrating power (dyeing at pH 4 to 5 and measured as difference in strength).

Examples of metal-free sulfonated dyes are C.I. Acid Blue 1, 7, 13, 23, 40, 40:1, 43, 45, 47, 72, 147, 258 and 277; C.I. Acid Red 1, 5, 37, 42, 52, 57 and 361; C.I. Acid Yellow 10, 17, 25, 27, 99 and 219; C.I. Acid Orange 1. 3 and 156; C.I. Acid Green 3, 9 and 16; C.I. Acid Violet 9 and 36; C.I. Acid Brown 10, 11 and 248.

In the process of this invention it is also possible to use mixtures of several dyes or dye mixtures as defined herein.

It is preferred to use a mixture of dyes as defined herein or dye mixtures which contain:

(a) at least two 1:1 chromium complex azo or azomethine dyes and optionally at least one sulfonated metal-free dye; and (b) at least three 1:1 chromium complex azo or azomethine dyes and optionally at least one sulfonated metal-free dye; or (c) for trichromatic dyeing, at least three 1:1 chromium complex azo or azomethine dyes selected from dyes that give yellow or orange, red and blue dyeings, and optionally at least one sulfonated metal-free dye selected from dyes that give yellow or orange and/or red and/or blue dyeings.

By trichromatic dyeing is meant the additive blending of suitably chosen dyes that give yellow or orange, red and blue dyeings with which any desired shade of the visible colour spectrum can be matched by suitable choice of the quantity ratios of the dyes.

1:1 Chromium azo or azomethine dyes employed in the process of this invention are, in particular, those of the formula

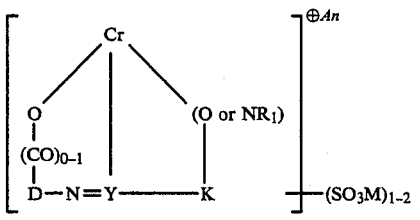

(4)

wherein —(CO)$_{0-1}$O— and (O or $NR_1$) are linked to D and K adjacent to the axo bridge, D is the radical of a diazo component of the benzene or naphthalene series, K is the radical of a coupling component of the benzene, naphthalene or heterocyclic series or of the acetoacetarylide series, $R_1$ is hydrogen or an unsubstituted or substituted alkyl or phenyl radical, M is a cation and An is an anion, and Y is a nitrogen atom or the —CH— group.

In the process of this invention it is preferred to use sulfonated 1:1 chromium complex azo or azomethine dyes of formula (4), wherein D is a radical of the benzene or naphthalene series which is unsubstituted or substituted by halogen, $C_1$–$C_4$alkyl, $C_1$–$C_4$alkoxy, nitro or sulfamoyl, K is a phenyl, naphthyl, 1-phenyl-3-methylpyrazol-5-one, acetoacetamide, preferably acetoacetanilide, or a quinoline radical, each unsubstituted or substituted by halogen, $C_1$–$C_4$alkyl, $C_1$–$C_4$alkoxy, $C_2$–$C_4$alkanoylamino, sulfamoyl or hydroxy, $R_1$ is hydrogen and M is an alkali metal cation.

Y in formula (4) is preferably a nitrogen atom.

The sulfonated metal-free dyes employed in the process of this invention are preferably those of the dyestuff series referred to above, which dyes may be substituted by e.g. $C_1$–$C_4$alkyl groups such as methyl, ethyl, propyl, isopropyl and butyl, or by $C_1$–$C_4$alkoxy groups such as methoxy, ethoxy, propoxy, isopropoxy and butoxy, or $C_1$–$C_6$acylamino groups such as acetylamino and propionylamino, benzoylamino, amino, $C_1$–$C_4$alkylamino, phenylamino, $C_1$–$C_4$alkoxycarbonyl, nitro, acetyl, cyano, trifluoromethyl, halogen such as fluorine, chlorine and bromine, sulfamoyl, carbamoyl, ureido, hydroxy, carboxy and sulfomethyl.

The sulfonated metal-free dyes may also be substituted by one or more fibre-reactive radicals. Examples of suitable fibre-reactive radicals are those listed in German Offenlegungsschrift No. 29 13 102.

In the process of this invention it is preferred to use mixtures of sulfonated 1:1 metal complex dyes and sulfonated metal-free dyes in the weight ratio of 40:60 to 95:5.

The sulfonated dyes employed in the process of this invention are either in the form of the free sulfonic acid or, preferably, of the salts thereof.

Examples of suitable salts are alkali salts, alkaline earth metal salts or ammonium salts, or the salts of an organic amine. Representative examples are the sodium, lithium, potassium or ammonium salts or the salt of triethanolamine.

The sulfonated 1:1 metal complex dyes and the sulfonated metal-free dyes employed in the process of this invention are known per se and can be obtained by known methods.

The mixtures of dyes used in the process of the invention may be prepared by mixing the individual dyes. Mixing is carried out in suitable mills, e.g. ball or pin mills, as well as in kneaders or mixers.

Further, the mixtures can also be prepared by spray drying aqueous dye mixtures.

In addition to containing the dye and the aforementioned assistants, the dyebaths may contain further conventional auxiliaries, for example wool protecting agents, wetting agents and antifoams.

The liqour to goods ratio may be chosen within a wide range from 1:6 to 1:80, preferably from 1:10 to 1:30.

Dyeing is carried out from an aqueous bath by the exhaust process, for example in the temperature range from 80° to 105° C. or 110° C. when using a wool protecting agent that splits off formaldehyde, preferably in the range from 98° to 103° C. The dyeing time is normally from 30 to 120 minutes.

Special apparatus is not required for carrying out the process of the invention. The conventional dyeing machines, e.g. for flocks, tops, hank yarn, packages, piece goods and carpets, may be used.

The levelling assistant and the alkali metal fluorosilicate or ammonium fluorosilicate is conveniently added to the aqueous dyebath and applied simultaneously with the dye. An alternative procedure is to treat the goods to be dyed first with the levelling assistant and then to dye the goods, in the same bath, after addition of the dye and of the alkali metal fluorosilicate or ammonium fluorosilicate. It is preferred to put the fibre material into a bath which contains acid and the assistant and has a temperature of 30° to 70° C. Then the dye mixture and the alkali metal fluorosilicate or ammonium fluorosilicate is added and the temperature of the dyebath is raised at a rate of 0.75° to 3° C. per minute, optionally with a temperature stop during the heating up phase, in order to dye in the indicated temperature range from 80° to 105° C., preferably for 30 to 120 minutes. Finally, the bath is cooled and the dyed material is rinsed and dried in conventional manner.

A particularly preferred procedure comprises putting the fibre material into a liquor that contains acid and a levelling agent which contains an alkali metal hexafluorosilicate or ammonium hexafluorosilicate or a mixture thereof as well as $Na_2SO_4$ and which has a temperature in the range from 30° to 70° C. Then the dyes or dye mixtures which contain the alkali metal hexafluorosilicate or ammonium hexafluorosilicate or mixture thereof are added, and the temperature of the dyebath is raised at a rate of 0.75° to 3° C. per minute, optionally with a temperature stop during the heating up phase, in order to dye in the indicated temperature range from 80° to 105° C. The bath is subsequently cooled and the dyed material is rinsed and dried in conventional manner.

Natural polyamide fibre material that may be dyed by the process of this invention is, in particular, wool and also wool/polyamide, wool/polyester, wool/cellulose or wool/polyacrylonitrile blends as well as silk. The fibre material may be in a very wide range of presentation, for example as loose material, tops, yarn and piece goods or carpets.

Synthetic polyamide material that may be dyed by the process of this invention comprises all known synthetic polyamides. The fibre material may be in a very wide range of presentation, for example as loose material, tops, yarn and piece goods or carpets.

A particularly preferred embodiment of the process of this invention comprises dyeing natural or synthetic polyamide fibre material, preferably wool, with at least one dye mixture as defined above, in the presence of ammonium fluorosilicate or sodium fluorosilicate, preferably in an amount by weight of 15 to 45 percent by weight, based on the amount by weight of 1:1 chromium complex dye, and in the presence of a levelling assistant comprising compounds of the formula (2) or a mixture of compounds of formulae (1) and (2) or (1), (2) and (3) or (1a), (2) and (3), and in the presence of sodium sulfate, in the pH range from 3.7 to 4.2.

The sulfonated metal-free dyes used in the process of the present invention may contain one or more fibre-reactive groups. In the process of the invention it is preferred to use those mixtures of 1:1 metal complex dyes and sulfonated metal-free dyes as defined herein, wherein the metal-free dyes are either all reactive dyes or are all devoid of fibre-reactive groups. It is most preferred to use sulfonated metal-free dyes that do not contain fibre-reactive groups.

A very particularly preferred embodiment of the process of the invention comprises the use of dye mixtures consisting of those metal-containing and metal-free dyes which give dyeings of the same shade, i.e. for example the use of a mixture of at least one sulfonated 1:1 metal complex dye and at least one sulfonated metal-free dye, each of which dyes in a blue shade.

Compared with the known processes for dyeing natural or synthetic polyamide fibre material, the process of this invention has the following advantages in addition to those already mentioned above.

The material dyed under the dyeing conditions has better allround fastness properties, in particular better wetfastness properties. A further essential advantage is that the dyes are taken up almost completely onto the fibre.

The process of this invention is preferably used for dyeing wool.

When dyeing is complete, the dyebath is almost completely exhausted.

Surprisingly, the process of this invention can be carried out using a substantially smaller amount of alkali metal hexafluorosilicate or ammonium hexafluorosilicate than the process disclosed in European patent application EP-A-No. 0 163 608.

The invention further relates to a composition for carrying out the process of the invention. The composition in a solid mixture containing at least one sulfonated 1:1 metal complex dye, in particular a 1:1 chromium complex dye, and optionally at least one sulfonated metal-free dye, and 10 to 45 percent by weight of an alkali metal fluorosilicate or ammonium fluorosilicate, based on the amount by weight of the 1:1 metal complex.

The composition of this invention is prepared by mixing at least one sulfonated 1:1 chromium complex dye and optionally at least one sulfonated metal-free dye 10 to 45 percent by weight of an alkali metal fluorosilicate or ammonium fluorosilicate, based on the weight of the 1:1 metal complex. Mixing is carried out, for example, in suitable mills, e.g. ball or pin mills, as well as in kneaders or mixers.

Preferred compositions contain sodium or ammonium fluorosilicate in addition to the dye mixture.

The solid mixtures can be used for dyeing natural or synthetic polyamide fibre materials. The same preferences apply to the solid mixtures as to the process.

The invention also relates to a further composition for carrying out the process of this invention. Said composition is a mixture containing a levelling assistant comprising one or more compounds of formula (1), (1a), (2) or (3), preferably a mixture of compounds of formulae (1a), (2) and (3), and 5 to 25 percent by weight of an alkali metal hexafluorosilicate or ammonium hexafluorosilicate, preferably $(NH_4)_2SiF_6$, based on the amount by weight of compounds of formulae (1), (1a), (2) or (3), or mixture thereof.

The composition is prepared by mixing at least one compound of formula (1), (1a), (2) or (3) with 5 to 25 percent by weight of an alkali metal hexafluorosilicate or ammonium hexafluorosilicate or mixture thereof. Mixing is effected e.g. in suitable mixers.

Together with the dye mixture containing an alkali metal hexafluorosilicate or ammonium hexafluorosilicate or mixture thereof, the composition can be used for dyeing natural or synthetic polyamide materials. The same preferences apply to the mixture as to the process.

The invention is illustrated by the following Examples, in which parts and percentages are by weight. The relationship of parts by weight to parts by volume is the same as that of the gram to the cubic centimeter. The indicated amounts of dye refer to untreated dye.

EXAMPLE 1

800 parts of worsted spun yarn are pretreated for 15 minutes at 50° C. in a dyebath containing, in 20,000 parts of water of 50° C., 64 parts of sodium sulfate, 0.55 part of $(NH_4)_2SiF_6$,
20 parts of 85% formic acid and
12 parts of a levelling assistant consisting of:
24 parts of the anionic compound of formula

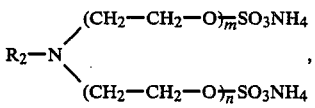

$R_2$=$C_{16}$-$C_{18}$hydrocarbon radical; m+n=7;
24 parts of the quaternary compound of formula

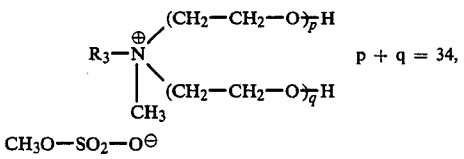

$R_3$=$C_{20}$-$C_{22}$hydrocarbon radical;
5 parts of ammonium chloride
3 parts of oxalic acid and
44 parts of water, based on 100 parts of levelling assistant.

After addition of a solution of
1.1 parts of the 1:1 chromium complex of the dye of formula

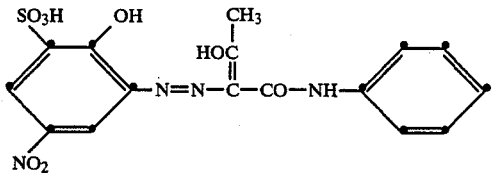

0.5 part of the 1:1 chromium complex of the dye of formula

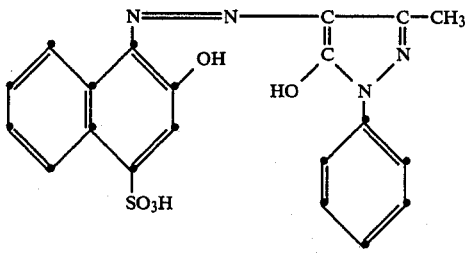

0.23 part of the 1:1 chromium complex of the dye of formula

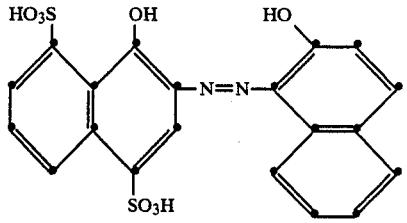

0.23 part of the 1:1 chromium complex of the dye of formula

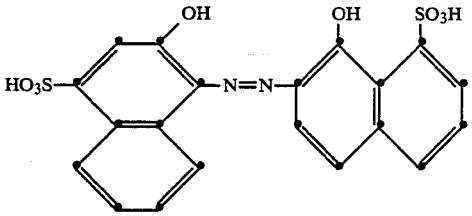

0.64 part of the dye of formula

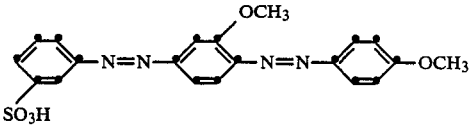

0.97 part of the dye of formula

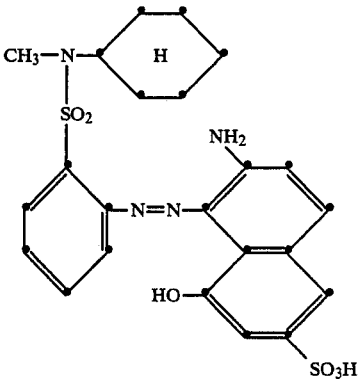

and 0.4 part of the dye of formula

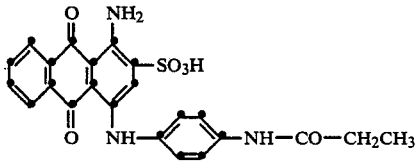

the dyebath is kept for 10 minutes at 50° C. and then heated to 98° C. at a rate of 0.8° C./minute. The pH is 3.8 at the commencement of dyeing. After a dyeing time of 90 minutes at 98° C., the dyebath is cooled to 50° C. and drained off. The brown wool yarn is rinsed first for 10 minutes at 50° C. and then for 10 minutes at room temperature and dried in conventional manner. The medium brown dyeing so obtained has excellent levelness and good fastness properties.

EXAMPLE 2

100 parts of wool fabric are pretreated for 15 minutes at 40° C. in a dyebath containing, in 2000 parts of water of 40° C., 8 parts of sodium sulfate, 1.2 parts of the levelling assistant employed in Example 1 and 2.3 parts of 85% formic acid. The pH of the bath is 3.7.

After addition of a solution of 0.18 part of $Na_2SiF_6$ and 0.21 part of the dye of formula

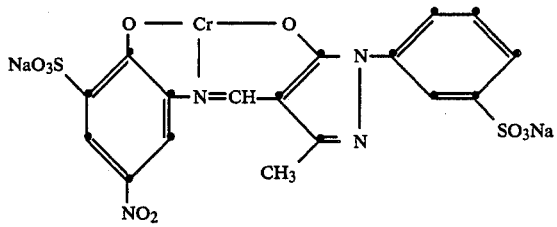

0.26 part of the dye of formula

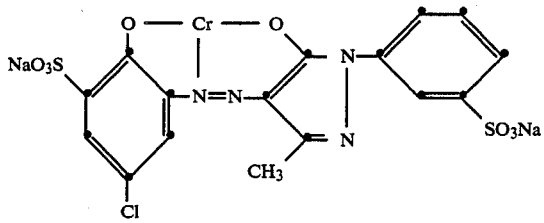

0.11 part of the dye of formula

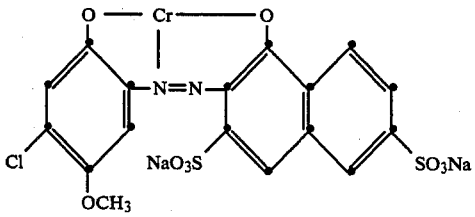

0.11 part of the dye of formula

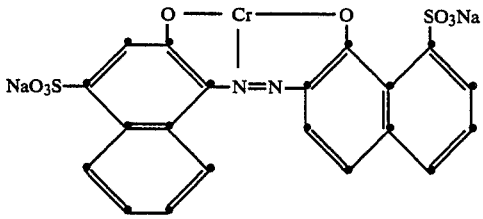

0.13 part of the dye of formula

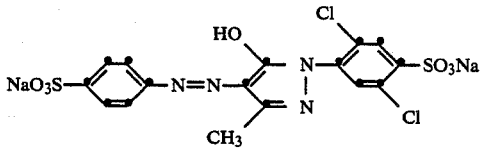

0.11 part of the dye of formula

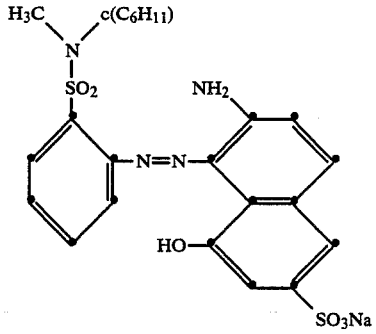

and 0.12 part of the dye of formula

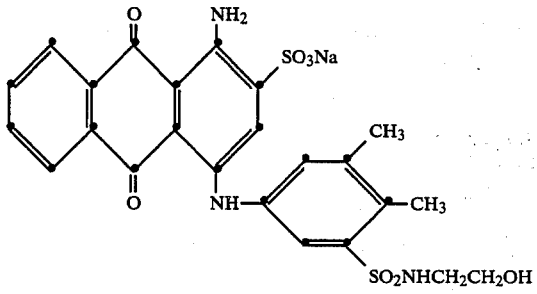

the dyebath is kept for a further 10 minutes at 40° C. and then heated to 70° C. at a rate of 1° C./min. After a dyeing time of 20 minutes at 70° C., the dyebath is heated to 100° C. and dyeing is carried out for 90 minutes at this temperature. The dyebath is then cooled to 60° C. and drained off. The brown wool fabric is rinsed first for 5 minutes at 50° C. and then for 5 minutes at room temperature and dried in conventional manner. The dyeing has excellent levelness and good fastness properties.

EXAMPLE 3

100 parts of wool fabric are pretreated for 10 minutes at 40° C. in a dyebath containing, in 1000 parts of water of 40° C., 8 parts of sodium sulfate, 1.5 parts of the levelling assistant employed in Example 1 and 2 parts of 85% formic acid. The pH of the bath is 3.8. After addition of a solution containing 0.49 part of the dye of formula

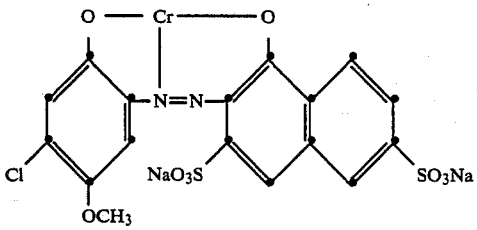

0.13 part of the dye of formula

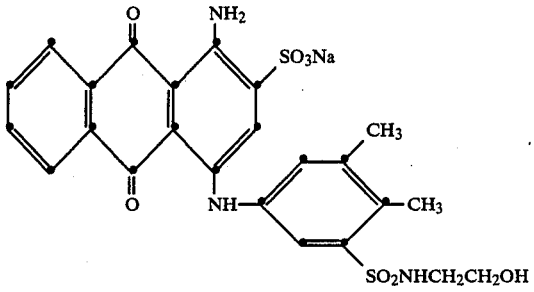

and 0.12 part of $(NH_4)_2SiF_6$,
the dyebath is kept for a further 10 minutes at 40° C. and then heated to 100° C. at a rate of 0.8° C./min. After a dyeing time of 90 minutes at 100° C., the dyebath is cooled to 60° C. and drained off. The blue wool fabric is rinsed and dried in conventional manner. The medium blue dyeing has excellent levelness and good fastness properties.

EXAMPLE 4

100 parts of wool fabric are pretreated for 15 minutes at 40° C. in a dyebath containing, in 1500 parts of water of 40° C., 8 parts of sodium sulfate, 1.5 parts of the levelling assistant of the following composition:
14.6 parts of the anionic compound of formula

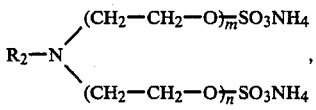

$R_2$=hydrocarbon radical of tallow amine, m+n=8;
21 parts of the quaternary compound of formula

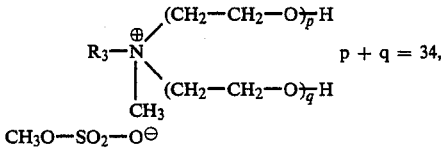

$R_3$=$C_{20}$-$C_{22}$hydrocarbon radical;
7.7 parts of the adduct of oleyl alcohol with 80 moles of ethylene oxide; and
7 parts of the compound of formula

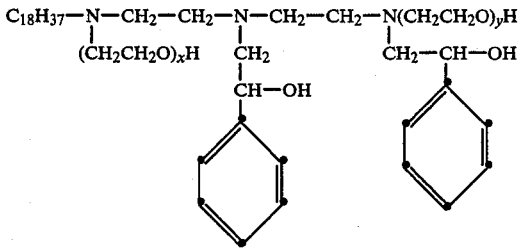

x + y = c. 100, and 49.7 parts of water, based on 100 parts of levelling assistant mixture;
and 2.6 parts of 8.5% formic acid. The pH of the bath is 3.8. After addition of a solution containing 0.30 part of $Na_2SiF_6$, 0.72 part of the dye of formula

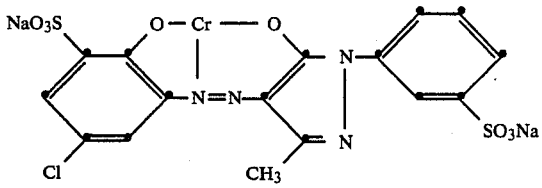

and 0.55 part of the dye of formula

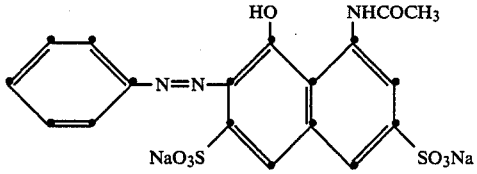

the dyebath is kept for a further 10 minutes at 40° C. and then heated to 100° C. at a rate of 0.8° C./min. After a dyeing time of 90 minutes at 100° C., the dyebath is cooled to 50° C. and drained off. The red wool fabric is rinsed and dried in conventional manner. The deep red dyeing so obtained has excellent levelness and good fastness properties.

EXAMPLE 5

100 parts of wool fabric are pretreated for 15 minutes at 40° C. in a dyebath containing, in 2000 parts of water of 40° C., 8 parts of sodium sulfate, 1.2 parts of the levelling assistant mixture employed in Example 1 and 2.3 parts of 85% formic acid. The pH of the bath is 3.7. To this dyebath are then added 0.43 part of a solid mixture consisting of:
0.09 part of $(NH_4)_2SiF_6$
0.13 part of the dye of formula

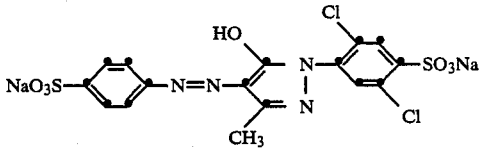

and 0.21 part of the dye of formula

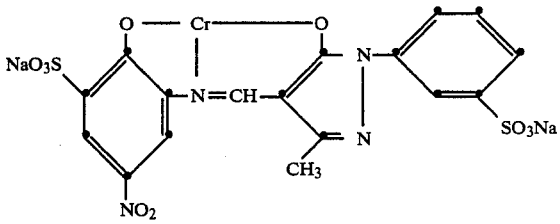

0.45 part of a solid mixture consisting of:
0.08 part of $(NH_4)_2SiF_6$,
0.26 part of the dye of formula

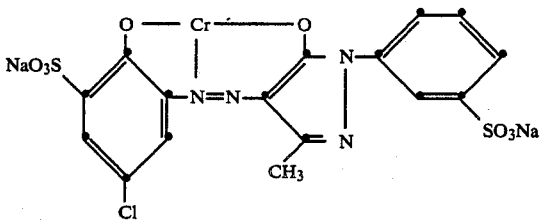

and 0.11 part of the dye of formula

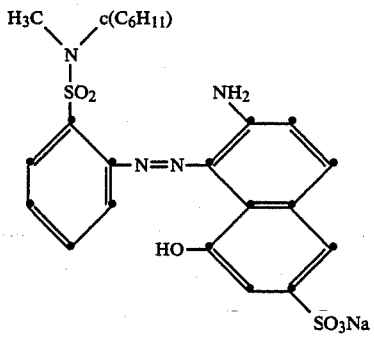

and 0.38 part of a solid mixture consisting of
0.04 part of $Na_2SiF_6$,
0.11 part of the dye of formula

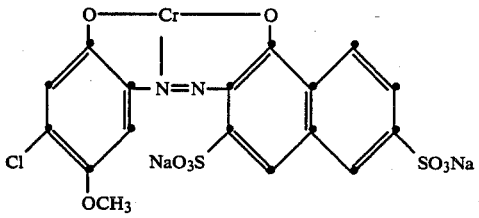

0.11 part of the dye of formula

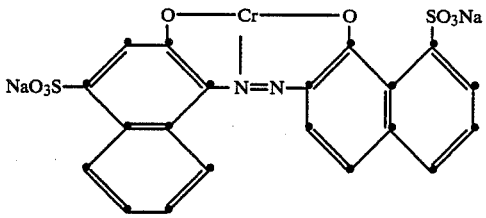

and 0.12 part of the dye of formula

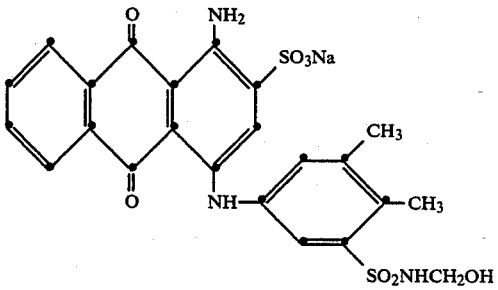

The dyebath is kept for a further 10 minutes at 40° C. and then heated to 70° C. at a rate of 1° C./min. After a dyeing time of 20 minutes at 70° C., the dyebath is heated to 100° C. and dyeing is carried out for 90 minutes at this temperature. The dyebath is then cooled to 60° C. and drained off. The brown wool fabric is rinsed first for 5 minutes at 50° C. and then for 5 minutes at room temperature and dried in conventional manner. The dyeing has excellent levelness and good fastness properties.

EXAMPLE 6

800 parts of worsted spun yarn are pretreated for 15 minutes at 50° C. in a dyebath which contains, in 20,000 parts of deionised water of 50° C., 40 parts of 80% acetic acid, 20 parts of crystalline sodium acetate and 12 parts of a levelling assistant comprising
14.6 parts of the anionic compound of the formula

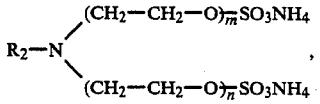

wherein $R_2$ is the hydrocarbon radical of tallow fatty amine, m+n=8;
21.0 parts of the quaternary compound of the formula

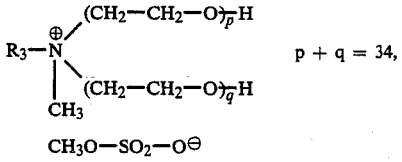

wherein $R_3$ is a $C_{20}$-$C_{22}$hydrocarbon radical;
7.7 parts of the reaction product of oleyl alcohol with 80 moles of ethylene oxide; and
7 parts of the compound of the formula

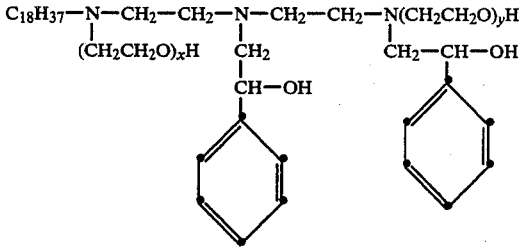

x + y = ca. 100, and 49.7 parts of water, based on 100 parts of the levelling assistant. After addition of a warm solution of 50° C. of 2.11 parts of the 1:1 chromium complex of the dye of formula

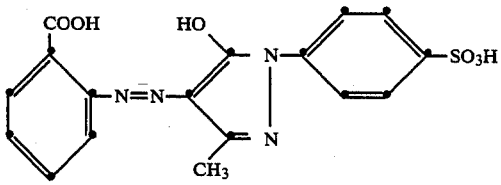

2.22 parts of the 1:1 chromium complex of the dye of formula

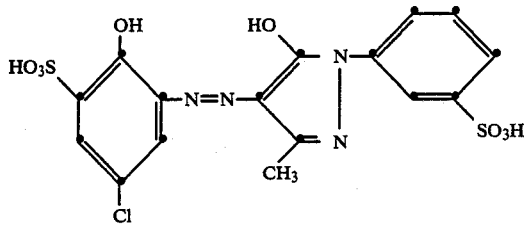

0.82 part of the 1:1 chromium complex of the dye of formula

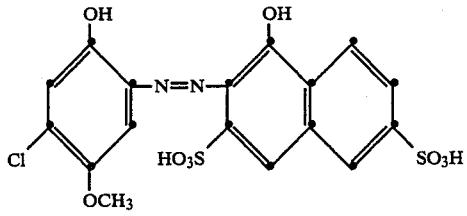

and 1.05 parts of the 1:1 chromium complex of the dye of formula

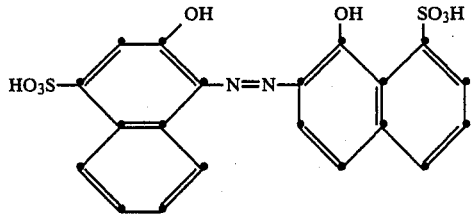

and 1.28 parts of $Na_2SiF_6$ in 1000 parts of water, the dyebath is kept for 10 minutes at 50° C. and then heated to 98° C. at a heating-up rate of 1° C./min. The pH is 4 at the commencement of dyeing. After a dyeing time of 90 minutes at 98° C., the brown wool yarn is rinsed first for 10 minutes at 50° C. and then for 10 minutes at room temperature, and dried in conventional manner. The pH is 4.2 at the conclusion of dyeing. The medium brown dyeing obtained has excellent levelness and the dyed yarn has a full, soft handle. The residual liquor is virtually colourless.

A dyeing obtained on yarn by the above process with the same dyes, but without the addition of $Na_2SiF_6$, is highly unlevel and quite markedly weaker. The residual liquor is still noticeably coloured.

EXAMPLE 7

800 parts of worsted spun yarn are pretreated for 15 minutes at 50° C. in a dyebath which contains, in 20,000 parts of water of 50° C., 64 parts of sodium sulfate, 0.82 part of $(NH_4)_2SiF_6$ and 12 parts of a levelling assistant comprising 24.0 parts of the anionic compound of the formula

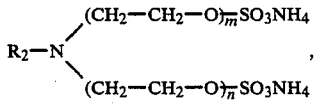

wherein $R_2$ is $C_{16}$–$C_{18}$hydrocarbon carbon radical and the sum of m+n is 7;

24.0 parts of the quaternary compound of the formula

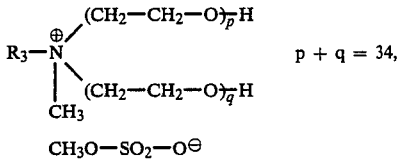

wherein $R_3$ is a $C_{20}$–$C_{22}$hydrocarbon radical;

5.0 parts of ammonium chloride 3.0 parts of oxalic acid, and 44 parts of water, based on 100 parts of the levelling assistant. After addition of a solution of 2.15 parts of the 1:1 chromium complex of the dye of the formula

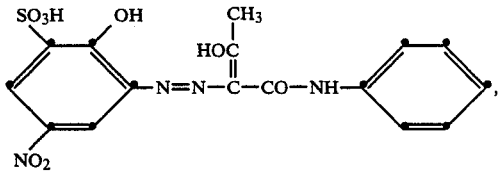

0.98 part of the 1:1 chromium complex of the dye of the formula

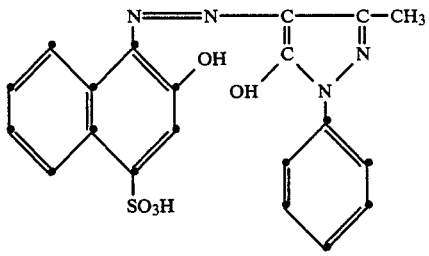

0.45 part of the 1:1 chromium complex of the dye of the formula

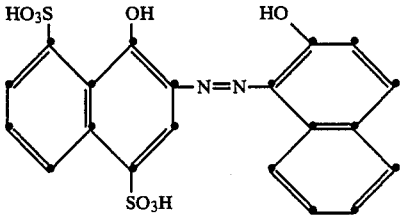

and 0.46 part of the 1:1 chromium complex of the dye of the formula

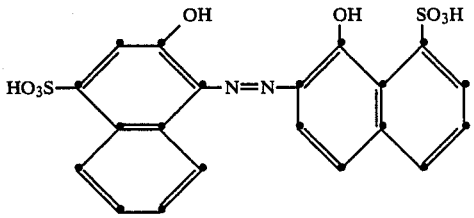

the dyebath is kept for 10 minutes at 50° C. and then heated to 98° C. at a heating-up rate of 0.8° C./min. The pH is 3.8 at the commencement of dyeing. After a dyeing time of 90 minutes at 98° C., the bath is cooled to 50° C. and drained off. The brown wool yarn is rinsed first for 10 minutes at 50° C. and then for 10 minutes at room temperature, and dried in conventional manner. The medium brown dyeing obtained has excellent levelness and has good fastness properties.

EXAMPLE 8

800 parts of worsted spun yarn are pretreated for 15 minutes at 50° C. in a dyebath which contains, in 20,000 parts of water of 50° C., 64 parts of sodium sulfate, 1.1 parts of $Na_2SiF_6$, 32 parts of 80% acetic acid and 12 parts of the levelling assistant employed in Example 7. After addition of a solution of 1.88 parts of the 1:1 chromium complex of the dye of formula

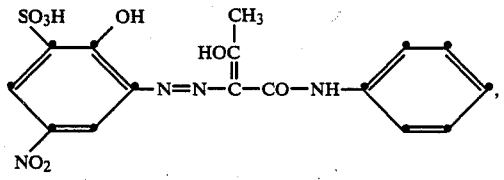

1.74 parts of the 1:1 chromium complex of the dye of formula

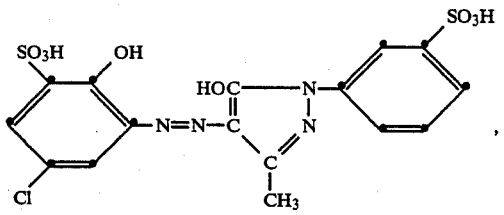

0.82 part of the 1:1 chromium complex of the dye of formula

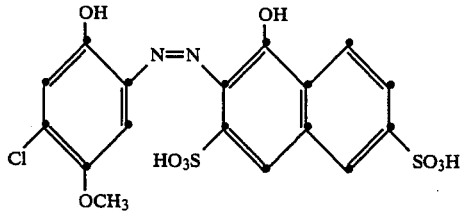

and 1.05 parts of the 1:1 chromium complex of the dye of formula

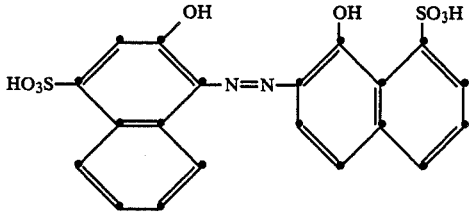

the dyebath is kept for 10 minutes at 50° C. and then heated to 70° C. at a heating-up rate of 1° C./min, kept for 20 minutes at 70° C. and then heated to 85° C. at a rate of 1° C./min. The pH is 4 at the commencement of dyeing. After a dyeing time of 120 minutes at 85° C., the bath is cooled to 50° C. and drained off. The brown wool yarn is rinsed first for 10 minutes at 50° C. and then for 10 minutes at room temperature, and dried in conventional manner. The full brown dyeing obtained has excellent levelness and has good fastness properties.

A dyeing obtained on yarn by the above process with the same dyes, but without the addition of $Na_2SiF_6$, is highly unlevel and quite substantially weaker.

EXAMPLE 9

800 parts of worsted spun yarn are pretreated for 15 minutes at 50° C. in a dyebath which contains, in 20,000 parts of water of 50° C., 64 parts of sodium sulfate, 1.55 parts of $Na_2SiF_6$, 20 parts of 85% acetic acid and 12 parts of the levelling assistant comprising 8.0 parts of the compound of the formula

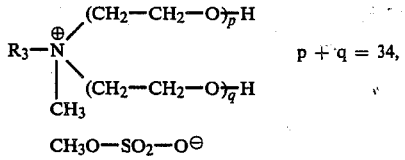

wherein $R_3$ is a $C_{17}$–$C_{21}$hydrocarbon radical;

30.0 parts of N,N'-dimethylolethylene urea, 0.7 part of the adduct of 5 moles of ethylene oxide and 1 mole of 2-ethyl-n-hexanol, 2.0 parts of a sulfated fatty amine polyglycol ether and 59.3 parts of water, based on 100 parts of levelling assistant. After addition of a solution of 2.7 parts of the 1:1 chromium complex of the dye of the formula

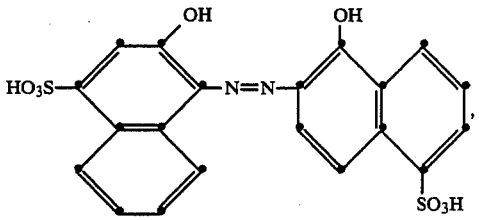

0.43 part of the 1:1 chromium complex of the dye of the formula

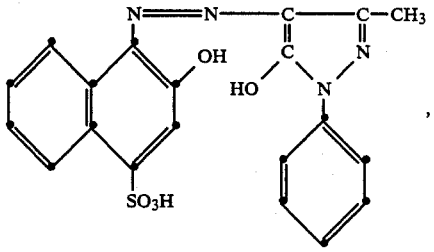

0.45 part of the 1:1 chromium complex of the dye of the formula

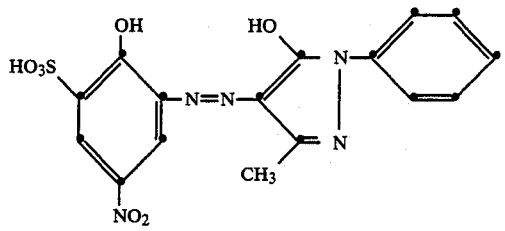

and 1.8 parts of the 1:1 chromium complex of the dye of the formula

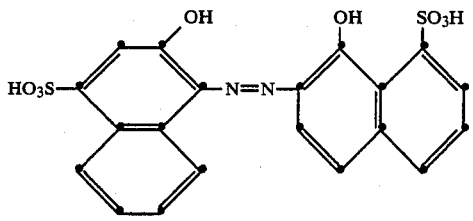

the dyebath is kept for 10 minutes at 50° C. and then heated to 70° C. at a heating-up rate of 1° C./min, then kept for 20 minutes at 70° C. and subsequently heated to 98° C. at a heat-up rate of 1° C./min. The pH is 3.7 at the commencement of dyeing. After a dyeing time of 90 minutes at 98° C., the dyebath is cooled to 60° C. and drained off. The navy blue wool yarn is rinsed twice for 10 minutes at 50° C. and then for 5 minutes at room temperature, and dried in conventional manner. The navy blue dyeing obtained has excellent levelness and has good fastness properties.

EXAMPLE 10

100 parts of polyamide 6,6 textured tricot are pretreated for 10 minutes in a dyebath which contains, in 4000 parts of water of 40° C., 0.1 part of $Na_2SiF_6$, 4 parts of ammonium acetate and acetic acid to adjust the pH to 4. After addition of a solution of 0.22 part of the 1:1 chromium complex of the dye of the formula

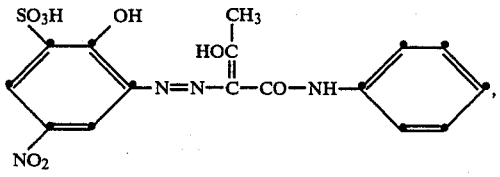

0.11 part of the 1:1 chromium complex of the dye of the formula

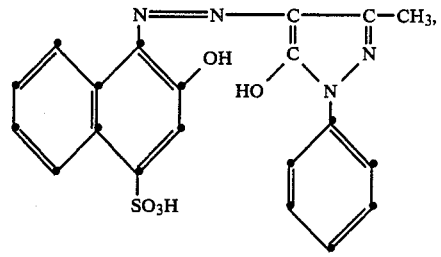

0.06 part of the 1:1 chromium complex of the dye of the formula

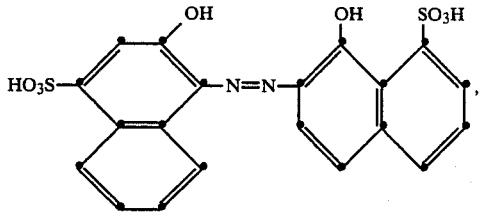

the dyebath is heated to 98° C. over the course of 45 minutes. Dyeing is carried out for 90 minutes at 98° C. and the bath is then cooled to 60° C. The dyed tricot is rinsed and dried in conventional manner. The medium brown dyeing obtained is somewhat purer and fuller than one obtained under the same conditions without the addition of $Na_2SiF_6$.

EXAMPLE 11

100 parts of woollen fabric are pretreated for 10 minutes at 40° C. in a dyebath which contains, per 1500 parts of water of 40° C., 8 parts of sodium sulfate, 1.5 parts of the levelling assistant of Example 1, and 2.6 parts of 85% formic acid. The pH of the dyebath is 3.7. After addition of a solution of 0.17 part of $(NH_4)_2SiF_6$ and 0.09 part of athe 1:1 chromium complex of the dye of formula

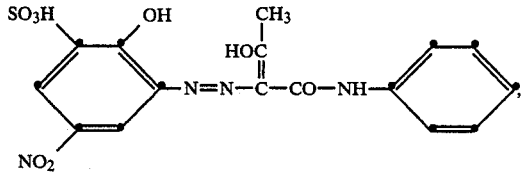

0.076 part of the 1:1 chromium complex of the dye of formula

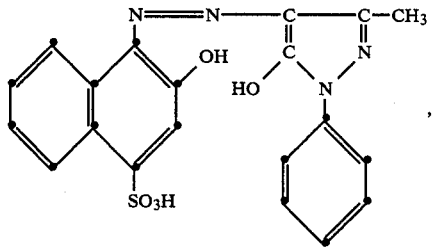

and 0.4 part of the 1:1 chromium complex of the dye of formula

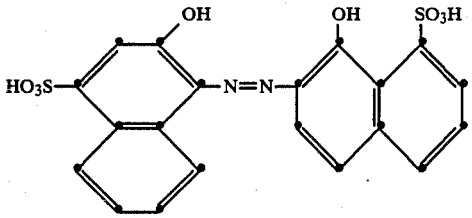

the dyebath is kept for 10 minutes at 40° C. and then heated to 70° C. at a rate of 0.8° C./minute. After dyeing for 10 minutes at 70° C., the dyebath is heated to 100° C. Dyeing is carried out for 90 minutes at 100° C., then the dyebath is cooled to 60° C. and drained off. The woollen fabric, which is dyed in a grey shade, is first rinsed for 5 minutes at 50° C. and then for 5 minutes at room temperature and dried in conventional manner. The dyeing so obtained has excellent levelness and good fastness properties.

The same result is obtained by using $Na_2SiF_6$ instead of $(NH_4)_2SiF_6$ or by mixing the dyes individually with $Na_2SiF_6$ or $(NH_4)_2SiF_6$ as powder, e.g.

0.09 part of the 1:1 chromium complex of the dye of formula

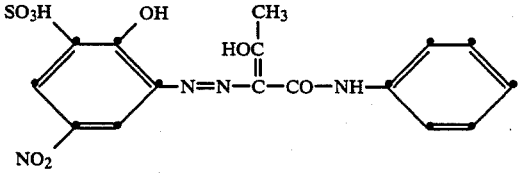

with 0.018 part of $(NH_4)_2SiF_6$;

0.076 part of the 1:1 chromium complex of the dye of formula

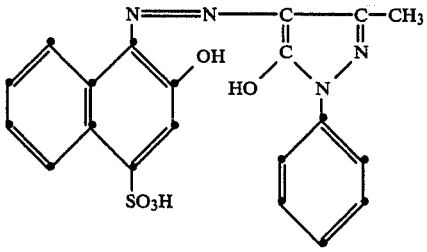

with 0.037 part of $(NH_4)_2SiF_6$;

0.4 part of the 1:1 chromium comaplex of the dye of formula

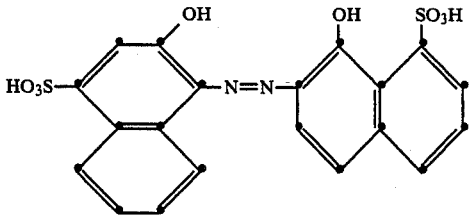

with 0.11 part of $(NH_4)_2SiF_6$

EXAMPLE 12

800 parts of worsted spun yarn are pretreated for 15 minutes at 50° C. in a dyebath which contains, in 14,400 parts of deionised water of 50° C., 28 parts of 85% formic acid, 64 parts of sodium sulfate and 12 parts of a levelling assistant comprising 10 parts of the anionic compound of formula

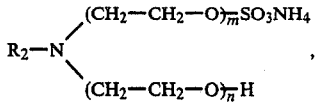

wherein $R_2$ is the hydrocarbon radical of tallow fatty amine, m+n=7;

10 parts of the quaternary compound of formula

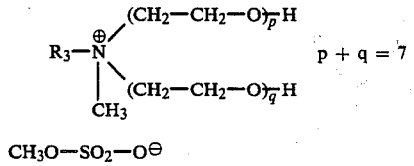

wherein $R_3$ is a $C_{20}$-$C_{22}$hydrocarbon radical;

2 parts of the adduct of oleyl amine with 80 moles of ethylene oxide; and 2 parts of the compound of formula

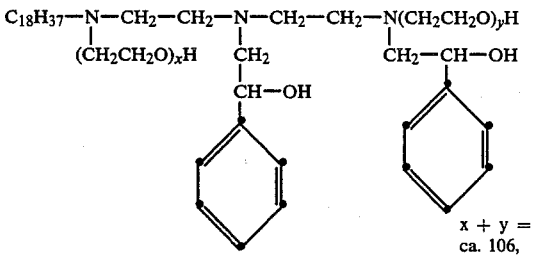

5 parts of the quaternary compound of formula

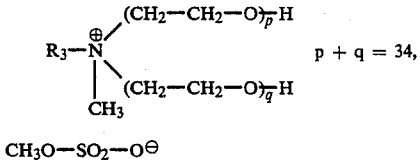

5 parts of $(NH_4)_2SiF_6$ and 66 parts of water, based on 100 parts of the levelling assistant. After addition of a warm solution of 50° C. containing 1.72 parts of a mixture comprising 0.96 part of the dye of formula

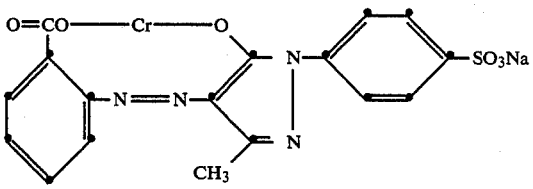

0.45 part of the dye of formula

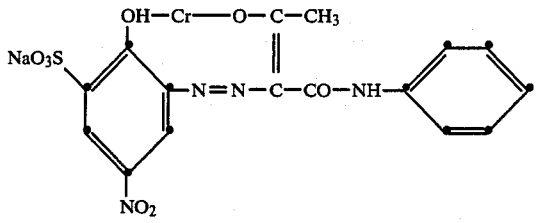

and 0.31 part of $(NH_4)_2SiF_6$;
1.88 parts of a mixture comprising
1.2 parts of the dye of formula

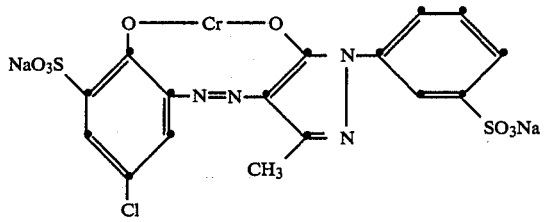

0.3 part of the dye of formula

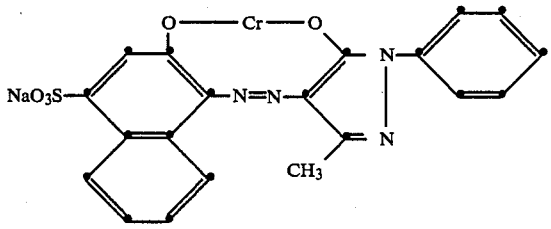

and 0.38 part of $(NH_4)_2SiF_6$; and
1.91 parts of a mixture comprising
1.5 parts of the dye of formula

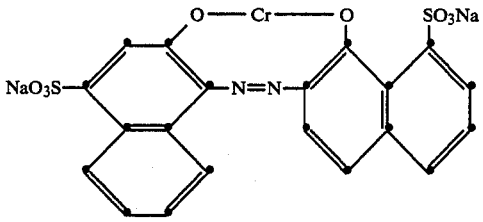

and 0.41 part of $(NH_4)_2SiF_6$ in 1000 parts of water, the dyebath is kept for 10 minutes at 50° C. and then heated to 98° C. at a rate of 1° C./minute. The pH is 3,5 at the commencement of dyeing. After a dyeing time of 90 minutes at 98° C., the dyebath is cooled to 50° C. and the light brown woollen yarn is rinsed first for 10 minutes at 50° C. and then for 10 minutes at room temperature and dried in conventional manner. The pH is 3.8 towards the conclusion of dyeing. The resultant beige dyeing has excellent levelness and the dyed yarn has a full, soft handle. The residual liquor is colourless. A dyeing obtained with the same dyes by the above process, but without the addition of $(NH_4)_2SiF_6$, is extremely unlevel and quite substantially weaker. The residual liquor is still noticeably coloured.

What is claimed is:

1. A process for dyeing natural or polyamide fibre material from an aqueous liquor with dyes, in the presence of an alkali metal salt or an ammonium salt and in the presence of an assistant, which process comprises dyeing said fibre material with at least one sulfonated 1:1 metal complex dye or with a mixture containing at least one sulfonated 1:1 metal complex dye and at least one sulfonated metal-free dye, in the presence of 20 to 35 percent by weight of an alkali metal fluorosilicate or ammonium fluorosilicate or a mixture thereof, based on the weight of the 1:1 metal complex dye employed, at a pH value in the range from 3 to 5.

2. A process according to claim 1, which comprises dyeing the fibre materials with a mixture comprising at least one sulfonated 1:1 metal complex dye and at least one sulfonated metal-free dye, in the presence of 20 to 35 percent by weight of an alkali metal fluorosilicate or ammonium fluorosilicate, based on the amount of the 1:1 metal complex dye employed, and in the presence of an assistant at a pH value in the range from 3 to 5.

3. A process according to claim 1, wherein dyeing is carried out in the presence of sodium fluorosilicate or, ammonium fluorosilicate.

4. A process according to claim 1, wherein dyeing is carried out in the presence of a mixture of $Na_2SiF_6$ and $(NH_4)_2SiF_6$.

5. A process according to claim 1, wherein the pH range of 3 to 5 is adjusted with an organic acid, and which optionally comprises using, in addition to an alkali metal fluorosilicate or ammonium fluorosilicate, another ammonium or alkali metal salt.

6. A process according to claim 1, wherein dyeing is carried out in a pH range from 3.5 to 4.5.

7. A process according to claim 1, wherein dyeing is carried out in the presence of a levelling assistant or a mixture of levelling assistants.

8. A process according to claim 7, which comprises using 0.3 to 3 percent by weight, based on the fibre material, of levelling assistant or mixture of levelling assistants.

9. A process according to claim 2, which comprises using a dye mixture that contains at least one 1:1 chromium complex azo or azomethine dye containing 1 to 3, sulfo groups and at least one metal-free dye containing 1 or 2 sulfo groups.

10. A process according to claim 9 for trichromatic dyeing, which comprises using a mixture of at least three 1:1 chromium complex azo or azomethine dyes selected from dyes that give yellow or orange, red and blue dyeings, and at least one metal-free dye selected from dyes that give yellow or orange and/or red and/or blue dyeings.

11. A process according to claim 1, wherein the 1:1 chromium complex azo or azomethine dyes employed are those of formula

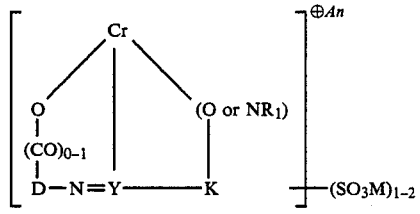

(4)

wherein $-(CO)_{0-1}O-$ and (O or $NR_1$) are linked to D and K adjacent to the azo bridge, D is a radical of the benzene or naphthalene series which is unsubstituted or substituted by halogen, $C_1$–$C_4$alkyl, $C_1$–$C_4$alkoxy, nitro or sulfamoyl, K is a phenyl, naphthyl, 1-phenyl-3-methylpyrazol-5-one, acetoacetamide or quinoline radical, each unsubstituted or substituted by halogen, $C_1$–$C_4$alkyl, $C_1$–$C_4$alkoxy, $C_2$–$C_4$alkanoylamino, sulfamoyl or hydroxy, $R_1$ is hydrogen, M is an alkali metal cation, and An is an anion, and Y is a nitrogen atom or the —CH— group.

12. A process according to claim 1, which comprises using mixtures of sulfonated 1:1 metal complex dyes and sulfonated metal-free dyes in the weight ratio of 40:60 to 95:5.

13. A process according to claim 6, wherein the metal-free sulfonated dyes are those of the monoazo, polyazo, anthraquinone, xanthene or triphenylmethane series.

14. A process according to claim 1, wherein the fibre material is silk or wool.

15. A process according to claim 11, wherein the fibre material is wool.

16. A composition comprising at least one sulfonated 1:1 metal complex dye, at least one metal-free sulfonated dye and 20 to 35 percent by weight of an alkali metal fluorosilicate or ammonium fluorosilicate, based on the weight of the 1:1 metal complex dye.

17. A composition comprising at least one sulfonated 1:1 metal complex dye, and 20 to 35 percent by weight of an alkali metal fluorosilicate or ammonium fluorosilicate, based on the weight of the 1:1 metal complex dye.

18. A composition comprising a compound of formula

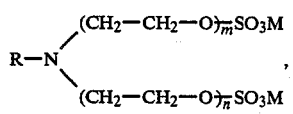

(1)

or

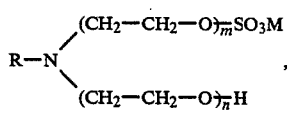

(1a)

wherein R is an alkyl or alkenyl radical, each of 12 to 22 carbon atoms, M is hydrogen, an alkali metal or ammonium cation, and m and n are integers, the sum of m+n being 2 to 14, or of formula

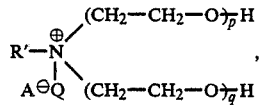

(2)

wherein R′, independently of R has the meaning of R, A is an anion, Q is an unsubstituted or substituted alkyl radical, and p and q are integers, the sum of p+q being 2 to 50, or of formula

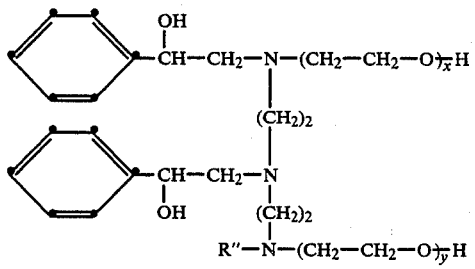

(3)

wherein R″ independently of R has the meaning of R, and x and y are integers, the sum of x+y being 80 to 140, a mixture comprising compounds of formulae (1) and (2) or a mixture comprising compounds of formulae (1), (2) and (3) or (1a), (2) and (3), as well as 5 to 25 percent by weight of $(NH_4)_2SiF_6$, based on the weight of the compounds of formulae (1), (1a), (2) or (3) or a mixture thereof.

19. A process according to claim 5, wherein the organic acid is formic acid or acetic acid.

20. A process according to claim 5, wherein the other alkali metal salt is an alkali metal sulfate.

21. A process according to claim 20, wherein the alkali metal sulfate is sodium sulfate.

22. A process according to claim 6, wherein dyeing is carried out in a pH range from 3.7 to 4.2.

23. A process according to claim 8, wherein the amount of levelling assistant or mixture of levelling assistants is 1 to 2 percent by weight.

24. A process according to claim 9, wherein the 1:1 chromium complex azo or azomethine dye contains 1 or 2 sulfo groups.

25. A composition according to claim 16, wherein the sulfonated 1:1 metal complex dye is a 1:1 chromium complex dye.

26. A composition according to claim 17, wherein the sulfonated 1:1 metal complex dye is a 1:1 chromium complex dye.

* * * * *

UNITED STATES PATENT AND TRADEMARK OFFICE

CERTIFICATE OF CORRECTION

PATENT NO. : 4,818,248

DATED : April 4, 1989

INVENTOR(S) : Gerhard BACK et al.

It is certified that error appears in the above-identified patent and that said Letters Patent is hereby corrected as shown below:

In the heading of the Patent, in item [54], change the title to

--PROCESS FOR DYEING NATURAL OR SYNTHETIC POLYAMIDE FIBRE MATERIALS WITH 1:1 METAL COMPLEX DYES IN PRESENCE OF ALKALI METAL FLUOROSILICATE OR AMMONIUM FLUOROSILICATE--.

Signed and Sealed this

Thirtieth Day of January, 1990

*Attest:*

JEFFREY M. SAMUELS

*Attesting Officer* *Acting Commissioner of Patents and Trademarks*